US010260162B1

(12) United States Patent
Heaton

(10) Patent No.: US 10,260,162 B1
(45) Date of Patent: Apr. 16, 2019

(54) METHODS OF LEACHING A SUPERABRASIVE BODY AND APPARATUSES AND SYSTEMS FOR THE SAME

(71) Applicant: US Synthetic Corporation, Orem, UT (US)

(72) Inventor: Daren Nathaniel Heaton, Spanish Fork, UT (US)

(73) Assignee: US SYNTHETIC CORPORATION, Orem, UT (US)

( * ) Notice: Subject to any disclaimer, the term of this patent is extended or adjusted under 35 U.S.C. 154(b) by 39 days.

(21) Appl. No.: 15/190,471

(22) Filed: Jun. 23, 2016

Related U.S. Application Data

(60) Provisional application No. 62/187,574, filed on Jul. 1, 2015.

(51) Int. Cl.

| | |
|---|---|
| ***B24D 3/02*** | (2006.01) |
| ***C25F 1/00*** | (2006.01) |
| ***E21B 10/567*** | (2006.01) |
| *B42D 3/00* | (2006.01) |
| *B42D 11/00* | (2006.01) |
| *C09K 3/14* | (2006.01) |

(52) U.S. Cl.
CPC ..... *C25F 1/00* (2013.01); *E21B 10/567* (2013.01)

(58) Field of Classification Search
USPC ..... 51/307, 293, 309
See application file for complete search history.

(56) References Cited

U.S. PATENT DOCUMENTS

| | | | | |
|---|---|---|---|---|
| 4,268,276 | A | 5/1981 | Bovenkerk | |
| 4,410,054 | A | 10/1983 | Nagel et al. | |
| 4,468,138 | A | 8/1984 | Nagel | |
| 4,560,014 | A | 12/1985 | Geczy | |
| 4,738,322 | A | 4/1988 | Hall et al. | |
| 4,811,801 | A | 3/1989 | Salesky et al. | |
| 4,913,247 | A | 4/1990 | Jones | |
| 5,016,718 | A | 5/1991 | Tandberg | |
| 5,092,687 | A | 3/1992 | Hall | |
| 5,120,327 | A | 6/1992 | Dennis | |
| 5,135,061 | A | 8/1992 | Newton, Jr. | |
| 5,154,245 | A | 10/1992 | Waldenstrom et al. | |
| 5,180,022 | A | 1/1993 | Brady | |
| 5,364,192 | A | 11/1994 | Damm et al. | |
| 5,368,398 | A | 11/1994 | Damm et al. | |
| 5,460,233 | A | 10/1995 | Meany et al. | |
| 5,480,233 | A | 1/1996 | Cunningham | |
| 5,544,713 | A | 8/1996 | Dennis | |
| 6,793,681 | B1 * | 9/2004 | Pope | A61F 2/30767 623/22.11 |
| 7,866,418 | B2 * | 1/2011 | Bertagnolli | C22C 26/00 175/420.2 |
| 2016/0339561 | A1 * | 11/2016 | Vail | B24D 3/10 |

OTHER PUBLICATIONS

U.S. Appl. No. 12/961,787, filed Dec. 7, 2010.
U.S. Appl. No. 14/520,188, filed Oct. 21, 2014.
U.S. Appl. No. 62/187,574, filed Jul. 1, 2015.
U.S. Appl. No. 62/096,315, filed Dec. 23, 2014.

* cited by examiner

*Primary Examiner* — James E McDonough
(74) *Attorney, Agent, or Firm* — FisherBroyles, LLP

(57) ABSTRACT

Embodiments of the invention relate to methods of removing interstitial constituents from superabrasive bodies using an ionic transfer medium, and systems and apparatuses for the same.

13 Claims, 7 Drawing Sheets

METHODS OF LEACHING A SUPERABRASIVE BODY AND APPARATUSES AND SYSTEMS FOR THE SAME

CROSS-REFERENCE TO RELATED APPLICATIONS

This application claims priority to U.S. Provisional Application No. 62/187,574 filed on Jul. 1, 2015, the disclosure of which is incorporated herein, in its entirety, by this reference.

BACKGROUND

Wear-resistant, superabrasive materials are traditionally utilized for a variety of mechanical applications. For example, polycrystalline diamond ("PCD") materials are often used in drilling tools (e.g., cutting elements, gage trimmers, etc.), machining equipment, bearing apparatuses, wire-drawing machinery, and in other mechanical systems.

Superabrasive elements having a superabrasive body or layer (e.g., a PCD table), may be formed and bonded to a substrate to form a compact, such as a polycrystalline diamond compact ("PDC"). Often, superabrasive elements that have a PCD table are fabricated by placing a cemented carbide substrate, such as a cobalt-cemented tungsten carbide substrate, into a container with a volume of diamond particles positioned on a surface of the cemented carbide substrate. The substrate and diamond particle volumes may then be processed under diamond-stable high-pressure high-temperature ("HPHT") conditions in the presence of a catalyst material, which causes the diamond particles to bond to one another to form a diamond table including a plurality of bonded diamond grains having interstitial regions therebetween. The catalyst material is often a metal-solvent catalyst, such as cobalt, nickel, or iron, which facilitates intergrowth and bonding of the diamond crystals. The catalyst may sweep in from the cemented-carbide substrate, such as cobalt from a cobalt-cemented tungsten carbide substrate, which liquefies and sweeps from a region adjacent to the volume of diamond particles into interstitial regions between the diamond particles during the HPHT process.

The presence of the metal-solvent catalyst and/or other materials in the PCD table may reduce a thermal stability of the PCD table at elevated temperatures. For example, a difference in the coefficients of thermal expansion between the diamond grains and the metal-solvent catalyst is believed to lead to chipping or cracking in the PCD table of a cutting element during drilling or cutting operations. The chipping or cracking in the PCD table may degrade the mechanical properties of the cutting element or lead to failure of the cutting element. Additionally, at high temperatures, diamond grains may undergo a chemical breakdown or back-conversion to graphite catalyzed by the metal-solvent catalyst.

Chemical leaching may be used to dissolve and remove the metal-solvent catalyst from the PCD table. Conventional chemical leaching techniques include soaking the PCD or the entire PDC in highly concentrated and corrosive (e.g., strongly acidic or basic) leaching solutions to dissolve and remove metal-solvent catalysts from PCD.

However, typical soaking times for the leaching process may include days, weeks, or months. Further, the leaching solutions can dissolve any portions of the substrate exposed to the leaching solution. Accordingly, when a PCD must be leached—in order to limit potential damage to the substrate—the PCD can be formed, leached, and then bonded to a substrate, or a masking technique can be used during leaching of a PDC.

Manufacturers and users of superabrasive elements, such as PDCs, continue to seek improved processing techniques.

SUMMARY

Embodiments of the invention relate to methods of removing interstitial constituents from superabrasive bodies, and systems and apparatuses for the same. In an embodiment, a method of removing interstitial constituents from superabrasive body is disclosed. The method includes providing an ionic transfer assembly. The ionic transfer assembly includes a first electrical connection operably coupled to a superabrasive body including a plurality of bonded superabrasive grains and at least one interstitial constituent. The ionic transfer assembly includes an ionic transfer medium in contact with the superabrasive body and an ionic reservoir in ionic communication with the ionic transfer medium and separated from the superabrasive body by the ionic transfer medium. The ionic reservoir includes a second electrical connection operably coupled thereto. The method includes applying a voltage between the first and second electrical connections and removing at least some of the at least one interstitial constituent from the superabrasive body through the ionic transfer medium to the ionic reservoir.

In an embodiment, a method of removing interstitial constituents from a PDC is disclosed. The method includes providing an ionic transfer assembly. The ionic transfer assembly includes at least one PDC including a PCD table having a plurality of bonded diamond grains with at least one interstitial constituent disposed therebetween, an upper surface, an interfacial surface, and a lateral surface extending between the upper surface and the interfacial surface. The PDC includes a substrate having a substrate interfacial surface bonded to the interfacial surface of the PCD table. The ionic transfer assembly includes a first electrical connection operably coupled to the substrate. The ionic transfer assembly of the method includes an ionic transfer medium in contact with the PCD table and an ionic reservoir in contact with the ionic transfer medium, the ionic transfer medium positioned between the PCD table and the ionic reservoir. The ionic transfer assembly includes a second electrical connection operably coupled to the ionic reservoir. The method includes applying a voltage between the first and second electrical connections. The method includes removing at least some of the at least one interstitial constituent from the at least one PDC through the ionic transfer medium and the ionic reservoir.

In an embodiment, a method of removing interstitial constituents from a PDC is disclosed. The method includes electrically oxidizing one or more interstitial constituents present in a PCD table of the PDC. The method includes moving the oxidized one or more interstitial constituents through a selective ionic transfer medium in contact with the PCD table. The method includes receiving the one or more oxidized interstitial constituents in an ionic reservoir in chemical communication with the selective ionic transfer medium.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments of the invention, wherein identical reference numerals refer to identical or similar elements or features in different views or embodiments shown in the drawings.

DETAILED DESCRIPTION

Figure 1A:
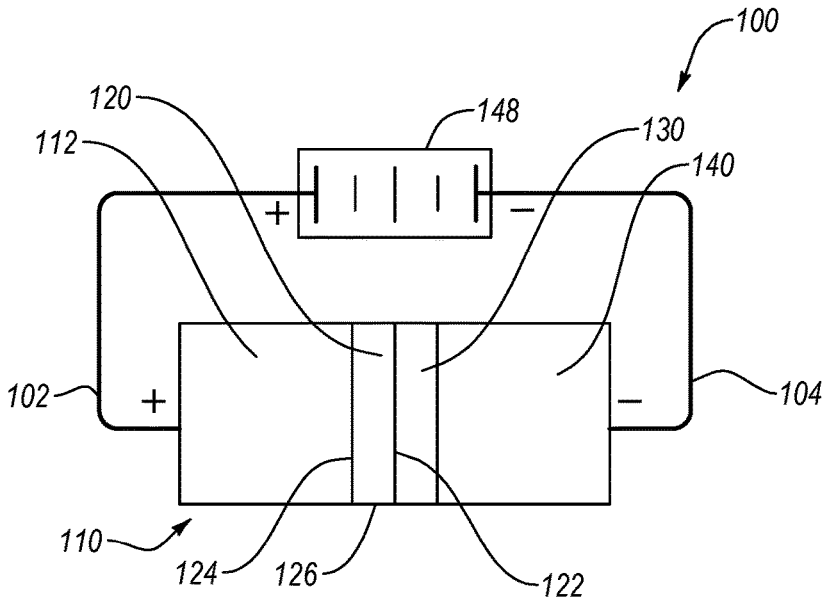
FIG. 1A is a schematic of an apparatus for removing interstitial constituents from a superabrasive body through an ionic transfer medium, according to an embodiment.

Embodiments disclosed herein relate to methods of removing interstitial constituents from superabrasive bodies, and systems and apparatuses for the same. More specifically, embodiments disclosed herein relate to methods of removing interstitial constituents from a superabrasive body (e.g., a PCD body) through an ionic transfer medium by applying a voltage between a substrate of a PDC and an ionic reservoir separated by the ionic transfer medium.

An assembly for removing interstitial constituents from a superabrasive body may include a first electrical connection (e.g., electrode) operably coupled to a workpiece (e.g., a PDC) including a superabrasive body bonded to a substrate. The assembly may include an ionic transfer medium (e.g., membrane) contacting or interfacing at least a portion of the superabrasive body and separating the superabrasive body from an ionic reservoir operably coupled to (e.g., in ionic communication with) the ionic transfer medium. The ionic reservoir may include a second electrical connection (e.g., electrode) operably coupled thereto. Upon application of a voltage between the first and second electrical connections, at least some of the interstitial constituents may be oxidized to cationic form, which may then be extracted through the ionic transfer medium into the ionic reservoir, such as by an electrochemical gradient. The ionic transfer medium may act as an ion bridge between the superabrasive body and the ionic reservoir to facilitate movement of ions therebetween.

Typical superabrasive compacts may include PDCs, cubic boron nitride ("CBN") compacts, or tungsten carbide compacts, among others. The embodiments herein may include PDCs (e.g., workpieces). However, any superabrasive material, such as any material having a hardness equal or greater than tungsten carbide, may be used in the methods and apparatuses disclosed herein.

PDCs including a PCD table may be fabricated by placing a cemented carbide substrate, such as a cobalt-cemented tungsten carbide substrate, into a container or cartridge with a volume of diamond particles positioned on a surface of the cemented carbide substrate. The diamond particles may exhibit one or more selected average particle sizes. The one or more selected average particle sizes may be determined, for example, by passing the diamond particles through one or more sizing sieves or by any other sizing method. In an embodiment, the plurality of diamond particles may include a relatively larger average particle size and at least one relatively smaller average particle size. As used herein, the phrases "relatively larger" and "relatively smaller" refer to particle sizes determined by any suitable method, which differ by at least a factor of two (e.g., 40 μm and 20 μm). In various embodiments, the plurality of diamond particles may include a portion exhibiting a relatively larger average particle size (e.g., 100 μm, 90 μm, 80 μm, 70 μm, 60 μm, 50 μm, 40 μm, 30 μm, 20 μm, 15 μm, 12 μm, 10 μm, 8 μm) and another portion exhibiting at least one relatively smaller average particle size (e.g., 30 μm, 20 μm, 10 μm, 15 μm, 12 μm, 10 μm, 8 μm, 4 μm, 2 μm, 1 μm, 0.5 μm, less than 0.5 μm, 0.1 μm, less than 0.1 μm). In an embodiment, the plurality of diamond particles may include a portion exhibiting a relatively larger average particle size between about 40 μm and about 15 μm and another portion exhibiting a relatively smaller average particle size between about 12 μm and 2 μm. Of course, the diamond particles may also include three or more different average particle sizes (e.g., one relatively larger average particle size and two or more relatively smaller average particle sizes), without limitation. The diamond particles may be placed adjacent to a catalyst, such as a metal-solvent catalyst (e.g., iron, nickel, cobalt, or alloys including one or more of the same) or a carbonate catalyst. The catalyst may be supplied from one or more sources such as the substrate (e.g., a cementing constituent), from a layer of catalyst positioned adjacent to the diamond powder, or may be mixed with the diamond powder (e.g., milled in with the diamond powder). The substrate may include a carbide such as one of tungsten carbide, niobium carbide, tantalum carbide, vanadium carbide, any refractory metal carbide, or combinations of any of the foregoing. The carbide substrate may include a cementing constituent, such as cobalt to form a cobalt-cemented tungsten-carbide substrate. Suitable cementing constituents may include iron, nickel, cobalt, or alloys including one or more of the same.

The substrate and diamond particle volumes may then be processed under diamond-stable HPHT conditions in the presence of the catalyst material, which causes the diamond particles to bond to one another to form a diamond table having a plurality of bonded diamond grains including interstitial regions therebetween. The HPHT process may be carried out in a high pressure cubic press. Suitable HPHT conditions may vary depending on the desired properties of the PCD table or PDC. Suitable HPHT temperatures may include 1000° C. and above, such as about 1200° C. to about 1600° C. Suitable HPHT pressures may include about 2 GPa or more, such as about 4 GPa to about 10 GPa, more than about 5 GPa, or more than about 7 GPa. Materials and methods of initially forming PDCs and resulting PDCs may be found in U.S. patent application Ser. No. 12/961,787 filed Dec. 7, 2010; and U.S. Pat. No. 7,866,418 issued on Jan. 11, 2011, the disclosure of each of which is incorporated herein, in its entirety, by this reference.

Under HPHT conditions, the catalyst material facilitates intergrowth and bonding of the diamond crystals. The catalyst may sweep in from the cemented-carbide substrate, such as cobalt from a cobalt-cemented tungsten carbide substrate, which liquefies and sweeps from a region adjacent to the volume of diamond particles into interstitial regions between the diamond particles during the HPHT process.

The presence of the metal-solvent catalyst and/or other materials in the diamond table may reduce a thermal stability of the PCD table at elevated temperatures or during cutting operations. For example, a difference in the coefficients of thermal expansion between the bonded diamond grains and the metal-solvent catalyst is believed to lead to chipping or cracking in the PCD table of a cutting element during drilling or cutting operations. The chipping or cracking in the PCD table may degrade the mechanical properties of the cutting element or lead to failure of the cutting element. Additionally, at high temperatures, diamond grains may undergo a chemical breakdown or back-conversion to graphite catalyzed by the metal-solvent catalyst. However, in order to render a PCD table thermally stable, conventional leaching may cause damage to substrates and/or require lengthy time periods (e.g., about a month) to complete. The methods and apparatuses herein may remove an interstitial constituent such as a metal-solvent catalyst from a superabrasive body sufficient to render the superabrasive body thermally stable in a relatively short amount of time and/or may provide better manufacturing yields.

FIG. 1A is a schematic of an ionic transfer assembly 100 for removing at least some of the interstitial constituents from a superabrasive body. The ionic transfer assembly 100 may include a first electrical connection 102 operably coupled to a PDC 110. The PDC 110 may include a superabrasive body 120 having a substrate 112 bonded thereto. For example, the PDC 110 may include a PDC having a PCD table and substrate bonded thereto. The PDC 110, such as the superabrasive body 120, may contact (e.g., electrically or chemically interface with) an ionic transfer medium 130. The ionic transfer medium may be selected and configured to selectively transport ions therethrough. The ionic transfer medium 130 may contact an ionic reservoir 140. The ionic transfer medium 130 and the ionic reservoir 140 may be in ionic communication (e.g., fluid or chemical communication) with each other, such that ionic species (e.g., metal cations and/or electrons) may pass from or through one to the other. The ionic transfer medium 130 may serve as a bridge or separation between the PDC 110 and the ionic reservoir 140. The ionic reservoir 140 may include a fluid (e.g., a solution) having selected ions therein. The ionic reservoir 140 may be operably coupled to a second electrical connection 104. The first and second electrical connections 102 and 104 may be operably coupled to one or more power sources 148.

The superabrasive body 120 may include a plurality of bonded superabrasive grains (e.g., diamond) having interstitial regions therebetween. The superabrasive body 120 may include an upper surface 122, an interfacial surface 124, lateral surface 126 therebetween, and optionally, a peripherally extending chamfer (FIGS. 2A-2G) between the lateral surface 126 and the upper surface 122. The interstitial regions may include one or more constituents therein. Interstitial constituents may include one or more of metal-solvent catalysts, other catalysts (e.g., carbonate catalysts) or reaction products thereof, metallic impurities, chemical impurities (e.g., salts), or substrate materials (e.g., tungsten carbide). The methods disclosed herein may be used to remove any of the foregoing. The techniques disclosed herein may also be used to reclaim materials from the substrate, such as carbide and/or cobalt from a cobalt-cemented tungsten carbide substrate.

During use of the ionic transfer assembly 100, a bias (e.g., voltage) may be applied between the first and second electrical connections 102 and 104. The first electrical connection 102 may have a positive potential and act as an anode, whereby at least some of the interstitial constituents in the superabrasive body 120 may be electrically removed (e.g., oxidized). For example, a metal-solvent catalyst, such as cobalt may be oxidized to cationic cobalt(II) or cobalt(III) as a result of the electrical current/voltage applied at the first electrical connection 102. The electrical connection 104 may have a negative potential and act as a cathode, whereby the at least a portion of the ionic reservoir 140 operably coupled thereto may also act as a cathode. For example, the ionic reservoir 140 may include an electrolytic solution therein. The electrolytic solution may include anions and cations (e.g., free cations or anions in an acidic solution), and upon inducing a negative potential to the second electrical connection 104, electrons may be supplied to the source of the negative potential (e.g., electrode), thereby attracting free cations in the ionic reservoir 140, which may result in plating of the removed material (e.g., metallic cations) at the second electrical connection. While a bias (e.g., voltage or current) is applied at the first and second electrical connections 102 and 104, at least some of the interstitial constituent in the PDC 110 may be ionized, dissolved, or oxidized; move through the ionic transfer medium 130; and move toward the negative potential at the second electrical connection 104, thereby removing at least some of the interstitial constituent from the PDC 110. In such a way, the ionic reservoir 140 may exhibit an ionic gradient in which positively charged ions are attracted to the negative potential upon being oxidized and are removed through the ionic transfer medium 130.

Using the methods and apparatuses disclosed herein, interstitial constituents may be selectively removed from one or more regions of a superabrasive element (e.g., polycrystalline diamond element) to provide a desired leached region therein. For example, the interstitial constituents may be selectively removed from one or more surfaces of a superabrasive element inward to a depth therein, from one or more discrete regions, or in a gradient (e.g., a portions substantially free of interstitial constituents at a surface extending inward and increasing in concentration to a depth therein). The leached regions herein may have any one of differing shapes, depths, or gradients therein. Such leached regions including gradients and methods of making the same are disclosed in U.S. Provisional Patent Application No. 62/096,315 filed on Dec. 23, 2014, the disclosure of which is incorporated herein in its entirety by this reference. The methods disclosed herein may be used to efficiently leach a PCD element or other superabrasive element and provide consistent results (e.g., consistent leach depths, regions, and/or gradients). For example, the consistency of the depth of the leached region and/or an amount of residual material therein, from one PDC to another PDC may be controlled by the techniques disclosed herein.

Embodiments of the material and structure of the ionic transfer medium 130 may vary from one embodiment to the next. For example and as discussed more detail below, the ionic transfer medium 130 may include one or more of a gel (e.g., agarose gel); a membrane (e.g., an ion selective membrane; a partially porous membrane, or a size selective membrane); a paper, sponge, or filter material (e.g., nitrocellulose paper); a solid polymer electrode or solid polymer electrode material; a supercritical fluid in combination with a solid polymer electrode, or any other suitable medium capable of selectively transporting ions therethrough. The ionic transfer medium 130 may include an electrolyte solution or another solution configured to transport oxidized species therein. Embodiments of the structure of the ionic reservoir 140 and/or the solution therein may vary. For example, and as discussed in more detail below, the ionic reservoir 140 may include one or more of a housing including a fluid (e.g., electrolytic solution in liquid or supercritical fluid form), a discrete amount of electrolytic solution remote from the surface of a superabrasive body in a gel contacting the superabrasive body, in a gel or fluid disposed in a porous material, or in a solid polymer electrolyte. In some embodiments, the ionic reservoir 140 may be omitted, with the second electrical connection 104 coupled directly to the ionic transfer medium 130. As discussed in more detail below, the ionic reservoir 140 may include acidic or basic solutions (e.g., a citric acid/citrate solution) of various concentrations and/or pH values.

Figure 1B:
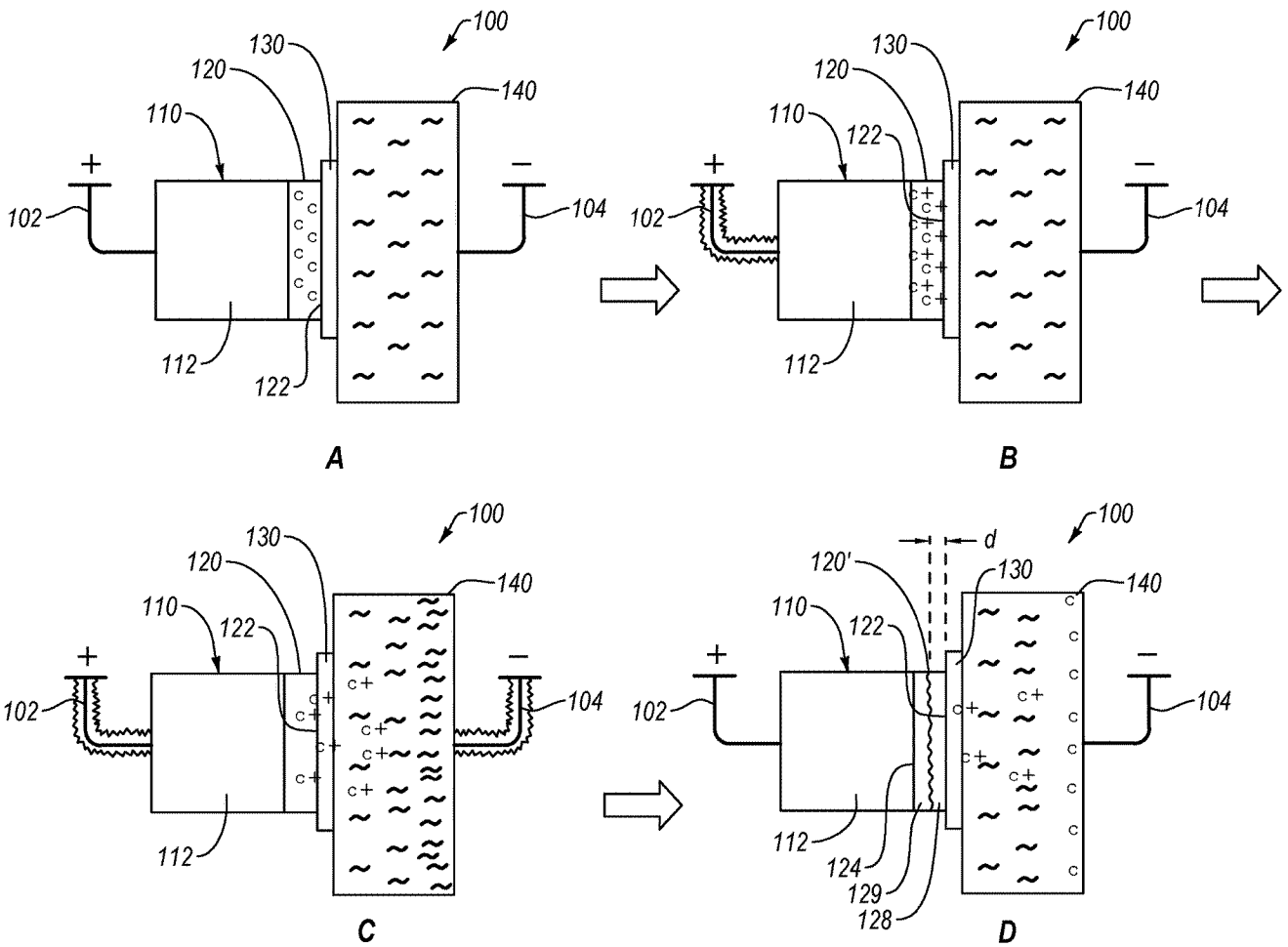
FIG. 1B is a schematic flow diagram of a method of removing interstitial constituents from a superabrasive body through an ionic transfer medium, according to an embodiment.

FIG. 1B is a schematic flow diagram of a superabrasive element at different points during the process of removing at least some of the interstitial constituent therefrom. At point A, the PDC 110 may be operably coupled to the first electrical connection 102, such as described above. The PDC 110 may include superabrasive body 120 and substrate 112, substantially as described above. For example, the superabrasive body may include a PCD table having a plurality of bonded diamond grains having at least one interstitial constituent material C in the interstitial regions therebetween. The interstitial constituent material C may include one or more of a metal-solvent catalyst (e.g., iron, nickel, cobalt, or alloys containing one or more of the same), other catalysts (e.g., one or more carbonate catalysts) or reaction products thereof, metallic impurities, chemical impurities, or substrate materials (e.g., tungsten carbide). At least a portion of the interstitial constituent material C may be configured to undergo electrolytic oxidation and/or electro-chemical dissolution upon application of a voltage thereto. For example, the interstitial constituent C may include cobalt, such as cobalt metal-solvent catalyst from the substrate or other source. The cobalt may be oxidized to cobalt(II) or cobalt(III) upon application of a voltage to the PDC 110 through the first electrical connection 102.

The superabrasive body 120 (e.g., table) may be placed adjacent to or in contact with the ionic transfer medium 130, such as having at least a portion of the upper surface 122 may be in direct contact therewith. The ionic transfer medium 130 may be positioned in contact (e.g., ionic communication) with the ionic reservoir 140, such as a reservoir having an electrolytic solution or material therein. The ionic transfer medium 130 may be interposed between the PDC 110 and the ionic reservoir 140. The ionic transfer medium 130 may be configured to selectively allow materials therethrough (e.g., size and/or ion specific transfer) and into the ionic reservoir 140. The ionic reservoir 140 may include an ionic or electrolyte solution or gel, such as an acidic solution, a basic solution, or any other solution suitable for carrying a voltage. The electrolyte solution may include any number or types of ions therein. The ionic transfer medium 130 may include some of the electrolyte solution, or another solution (e.g., a different electrolyte solution, water, acid, etc.) therein. The ionic reservoir 140 may include the second electrical connection 104 operably coupled thereto (e.g., in electrical communication). The second electrical connection 104 may be configured to apply a bias thereto, which may result in a negative potential at the second electrical connection 104 and/or the portions of the ionic reservoir 140 adjacent to the second electrical connection 104. The first and second electrical connections 102 and 104 may include any conducting material such as copper, tungsten carbide, cobalt, zinc, iron, steel, platinum, palladium, niobium, graphite, nickel, gold, silver, alloys including of any of the foregoing, or combinations of any of the foregoing.

At point B, a positive potential (e.g., voltage) may be applied to the first electrical connection 102. The voltage may electrically oxidize one or more interstitial constituents C in the superabrasive body 120. The interstitial constituent C may be oxidized to an anionic or more strongly positive ionic form to an interstitial constituent C. The interstitial constituent $C^+$ may be extracted from the superabrasive body 120 using one or more methods and apparatuses disclosed below. In an embodiment, the interstitial constituent C may include cobalt that is electrically oxidized to form the interstitial constituent $C^+$, cobalt(II) or cobalt(III). The interstitial constituent $C^+$ may be less strongly attached or attracted to one or more components of the superabrasive body, such that the continued bias may at least partially cause the interstitial constituent $C^+$ to be motivated (e.g., by ionic or electrochemical gradient) away from the first electrical connection 102 and the superabrasive body 120 in electrical connection therewith. The interstitial constituent $C^+$ may then move into and/or through the ionic transfer medium 130.

As shown at point C, application of voltage at the second electrical connection 104 may result in a negative potential therein, whereby one or more portions of the ionic reservoir 140 operably coupled thereto may carry the negative potential. The negative potential may provide motivation (e.g., via electrochemical gradient) for any positive ions or other species in the ionic reservoir attracted to the negative potential to move towards the second electrical connection 104. For example, the interstitial constituent $C^+$ may be moved (e.g., pushed from the positive portion of the electrically induced gradient at the first electrical connection 102 and pulled toward the negative portion of the electrically induced gradient at the second electrical connection 104) toward the second electrical connection 104 by ionic attraction thereto.

While shown as separate, points B and C may be carried out substantially simultaneously. For example, points B and C may occur substantially simultaneously when an electrical bias (e.g., voltage) is applied from the power source (not shown) between the first and second electrical connections 102 and 104. The bias may be supplied at both electrical connections (e.g., electrodes) from the same power source sufficient to cause the ionic transfer assembly 100 to remove at least a portion of the interstitial constituents C from the PDC 110 operably coupled thereto. The electrical bias may include a voltage of less than about 10 V between the first and second electrical connections 102 and 104, such as about 0.01 V to about 5 V, about 0.5 V to about 3 V, 0.1 V to about 3 V, 0.4 V to about 2.4 V, about 0.5 V, 0.6 V, 0.7 V, 0.8 V, 0.9 V, or about 1.0 V may be applied between the first and second electrical connections 102 and 104. In some embodiments, the voltage may be adjusted during the application of the electrical bias to accommodate changing conductivity in the ionic reservoir or ionic transfer medium due to migration of the interstitial constituent therein. The voltages above may be used in any of the embodiments disclosed herein.

While the electrical bias is applied, interstitial constituents C may be electrically oxidized adjacent to the first electrical connection 102 (e.g., at the superabrasive body 120) to provide interstitial constituent $C^+$ and are moved toward the negative potential at or adjacent to the second electrical connection 104. Specifically, the interstitial constituent $C^+$ at or near the upper surface 122 move into the ionic transfer medium 130 and into the ionic reservoir 140 via gradient (e.g., ionic or electrochemical gradient). The interstitial constituent $C^+$ may move through the ionic reservoir toward the negative potential.

As shown at point D, the interstitial constituent $C^+$ may move through the ionic reservoir 140 toward the negative potential at the second electrical connection 104 whereby the interstitial constituent $C^+$ may be reduced thereby allowing the interstitial constituent C to deposit (e.g., plate) at or adjacent to the second electrical connection 104. Upon terminating the electrical bias, the interstitial constituent C remains plated onto one or more surfaces in the ionic reservoir 140 (such as at or adjacent to the second electrical connection 104), or as agglomerates of the interstitial constituent C in the ionic reservoir. As more interstitial constituent $C^+$ is removed from the superabrasive body 120 at or near the upper surface 122, the superabrasive body 120 may develop at least one region having a reduced amount of the interstitial constituent C therein. For example, the resulting leached PDC may include a superabrasive body 120' having a first region 128 adjacent to the upper surface 122 and a second region 129 extending from the interfacial surface 124 inward. In an embodiment, substantially all of the interstitial constituent C may be removed from one or more portions of the superabrasive body 120 (e.g., the entire body or a discrete region therein).

The first region 128 may exhibit a reduced amount of at least one interstitial constituent therein compared to the second region 129. In an embodiment, the interstitial constituent in an unleached or untreated PCD table may represent about at least about 5 weight % of the weight of the superabrasive body 120, such as about 5 weight % to about 12 weight % of the weight of a selected region of the PCD table. In an embodiment, the interstitial constituent in the second region 129 may represent about 5 weight % to about 12 weight % of the weight of the second region 129 of the superabrasive body 120. In an embodiment, the least one interstitial constituent in the first region 128 may represent less than about 6 weight % of the weight of a selected volume or region of the first region 128 of the superabrasive body 120, such as about 0 weight % to about 6 weight %, about 0.5 weight % to about 3 weight %, about 1 weight % to about 5 weight %, about 0.25 weight % to about 2 weight %, greater than 0 weight percent to about 1.5 weight %, or about 1 weight % of the weight of a selected volume of the first region 128 of the superabrasive body 120.

The first region 128 may extend a discrete (average) depth d into the superabrasive body 120 from the contact surface with the ionic transfer medium 130 to the second region 129. Generally, the depth d may depend on any number of factors including one or more of duration of electrical bias, the voltage applied, the current applied, the type of ionic transfer medium, the thickness of the ionic transfer medium, the type of interstitial constituent, the electrolyte solution (e.g., composition and/or concentration), or any other suitable criteria. The depth d may extend about 50 μm or more into the superabrasive body from one or more surfaces thereof, such as about 50 μm to about the entire thickness of the superabrasive body, about 100 μm to about 500 μm, about 50 μm to about 400 μm, about 500 μm to about 1000 μm, about 600 μm to about 800 μm, over 1000 μm, 1000 μm to about 1500 μm, about 150 μm to about 250 μm, about 100 μm to about 300 μm, or about 200 μm into the superabrasive body from one or more surfaces thereof. In an embodiment, one or more portions of the superabrasive body 120' may exhibit a gradient of interstitial constituent content therein. For example, after a bias is applied to the electrical connections 102 and 104 for a selected amount of time the superabrasive body 120' may exhibit a gradient having a higher concentration of interstitial constituent adjacent to the interfacial surface 124 which gradually decreases to a lower concentration of interstitial constituent at or near the upper surface 122 (e.g., adjacent to those regions the of superabrasive body 120 in contact with the ionic transfer medium 130). Selected amounts of time for application of the bias may include 1 hour or more such as about 1 hour to about 2 weeks, about 4 hours to about 1 week, about 8 hours to about 3 days, about 12 hours to about 48 hours, about 48 hours to about 2 weeks, about 4 days to about 11 days, about 5 days to about 10 days, about 1 week, or about 24 hours. Such electrochemical leaching, (e.g., even for the short durations noted above), may reduce the amount of time necessary to form a thermally stable superabrasive element compared to conventional leaching and/or may selectively remove one or more interstitial constituents while leaving one or more other interstitial constituents within the superabrasive element.

While shown as a flat (e.g., planar) surface contacting the superabrasive body 120 along the upper surface 122, the contact surface between the superabrasive body 120 and the ionic transfer medium 130 may have many configurations. Similarly and as explained in more detail below, the resulting leached superabrasive body 120' may have one or more regions 128 and 129 having different amounts of the at least one interstitial constituent therein in any one of a number of configurations. The one or more regions 128 and 129 may include a gradient (e.g., a concentration gradient) of interstitial constituent therein, such as any of the gradients disclosed in U.S. Provisional Patent Application No. 62/096,315 the disclosure of which is incorporated herein above. Removing at least a portion of the interstitial constituent from at least a portion of the PDC 110 or superabrasive body 120 may include contacting at least a portion of one or more surfaces (e.g., upper surface 122, lateral surface 126, or chamfer) of the PDC 110 or superabrasive body 120 with at least a portion of the ionic transfer medium 130.

In some embodiments, the superabrasive body or a portion thereof may be electrically and/chemically contacted (e.g., placed directly adjacent to or placed in electrical and/or chemical communication) with at least a portion of the ionic transfer medium, such that at least a portion of the interstitial constituent in the superabrasive body adjacent to the contact surface may be removed. In some embodiments, one or more of the superabrasive body or the ionic transfer medium may be configured to contact less than the entire outer surface (e.g., only one of or a portion of the upper surface, lateral surface, and/or chamfer) of the superabrasive body with the ionic transfer medium. Such embodiments may allow the interstitial constituent to be selectively removed from only a portion of the superabrasive body.

FIGS. 2A-2G are cross-sectional views of the interface or contact surfaces between a PDC 210 and the ionic transfer medium 230 in various ionic transfer assemblies; and the resulting leached PDCs **210*a*-210*g*. The ionic transfer medium 230 may be similar or identical to any ionic transfer medium disclosed herein. The PDC 210 may be similar or identical to the PDC 110, with like parts having like numbering (e.g., superabrasive body 220 may be similar or identical to superabrasive body 120). For example, the PDC 210 may include a substrate 212 bonded to a superabrasive body 220 (e.g., a PCD table bonded to a cobalt-cemented tungsten carbide substrate). The superabrasive body 220 may include an upper surface 222, an interfacial surface 224, a lateral surface 226 therebetween, and optionally, a chamfer 227 extending between the lateral surface 226 and the upper surface 222. The superabrasive body 220 may be in chemical (e.g., ionic) and/or electrical communication with the ionic transfer medium 230, such that ionized chemical species may be selectively transported from the superabrasive body 220 through the ionic transfer medium 230**. While the following embodiments are described in terms of PDCs, the methods and systems described herein can be used with any superabrasive body.

Figure 2A:
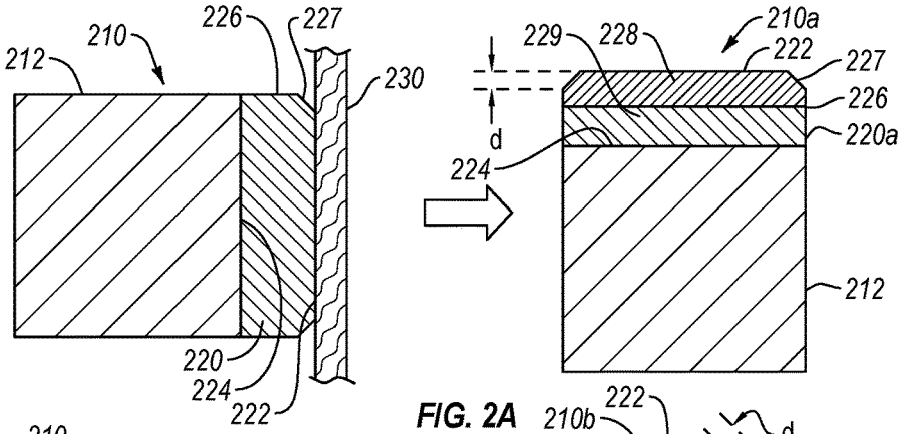
FIGS. 2A-2G are cross-sectional views of a contact surface between a PDC and an ionic transfer medium, and the resulting leached PDCs, according to various embodiments.

As shown in FIG. 2A, the ionic transfer medium 230 may include a substantially planar surface that contacts the PDC 210. The PDC 210 may contact the ionic transfer medium 230 along at least a portion of the upper surface 222. In an embodiment, positioning the PDC in contact with the ionic transfer medium 230 may include contacting the entire upper surface 222 of the superabrasive body 220 with the ionic transfer medium 230. The resulting leached PDC 210*a* may include a first region 228 extending inward from the upper surface 222 of the superabrasive body 220*a* to depth d therein. The depth d of the region 228 may extend substantially parallel to the surface contacting the ionic transfer medium 230 (e.g., the upper surface 222). The depth d may extend substantially uniformly from the across the entire lateral length of the upper surface 222. The first region 228 may include a reduced amount (e.g., as compared to the as-sintered PCD) of interstitial constituent therein. The leached PDC 210*a* may include a second region 229 extending inward from the interfacial surface 224. The second region 229 may include substantially more of the interstitial constituent therein than the first region 228, such as substantially the same amount of interstitial constituent that was present (in region 229) before applying the bias to the electrical connections. The first region 228 may include the chamfer 227 or at least a portion of the superabrasive body 220*a* adjacent to the chamfer 227.

Figure 2B:
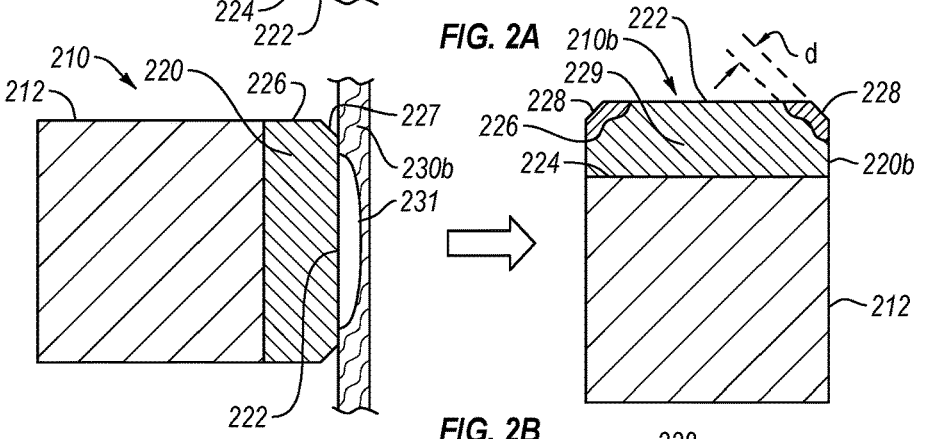

As shown in FIG. 2B, the ionic transfer medium 230*b* may contact only a portion of the upper surface 222 of the superabrasive body 220. The ionic transfer medium 230*b* may include a recess 231 configured to prevent or limit contact between a portion of the ionic transfer medium 230*b* with the superabrasive body 220. For example, the recess 231 may be configured to allow only the peripheral areas of the upper surface 222 to contact the ionic transfer medium 230*b*. For example, the recess 231 may extend laterally a distance of about 50% or more of the diameter of the upper surface 222, such as about 60% to about 95%, about 75% to about 90%, or about 80% of the diameter of the upper surface 222. The PDC 210 may contact the ionic transfer medium 230*b* along only a portion of the upper surface 222. In an embodiment, positioning the PDC in contact with the ionic transfer medium 230*b* may include contacting only a portion of the upper surface 222 of the superabrasive body 220 with the ionic transfer medium 230*b*. The resulting leached PDC 210*b* may include a first region 228 extending inward from the upper surface 222 about the peripheral portions (e.g., defining an annular first region 228) of the upper surface 222 of the superabrasive body 220*b* to the depth d therein. The depth d of the region 228 may extend substantially parallel to the surface contacting the ionic transfer medium 230 (e.g., the upper surface 222). The depth d may extend substantially uniformly inward from the periphery of the upper surface 222, which may include at least a portion of the chamfer 227. The leached PDC 210*b* may include a second region 229 extending inward from the interfacial surface 224. In an embodiment, at least a portion of the second region 229 may extend to the upper surface 222, such as a portion interior to the first region 228. The first region 228 may include at least a portion of the chamber 227 and/or portions of the superabrasive body 220*b* adjacent to the chamfer 227.

Figure 2C:
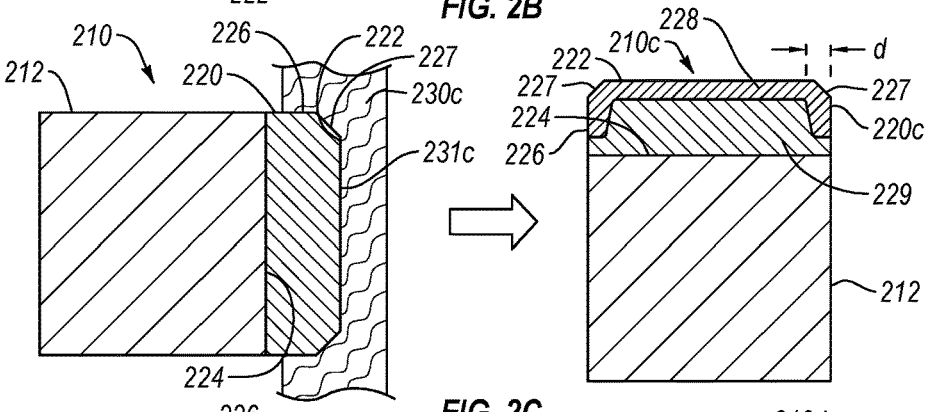

As shown in FIG. 2C, the ionic transfer medium 230*c* may include a surface contacting the upper surface 222 and at least a portion of the lateral surface 226 of the superabrasive body 220. The ionic transfer medium 230*c* may include a recess 231*c* configured to accommodate at least a portion of the superabrasive body 220 therein. For example, the recess 231*c* may be configured to allow at least a portion of both of the lateral surface 226 and the upper surface 222 to contact the ionic transfer medium 230*c*. For example, the recess 231*c* may extend the entire diameter of the upper surface 222 and at least a portion of the length of the lateral surface 226. In an embodiment, the recess 231*d* may be configured to extend inward at least about 10% of the length of the lateral surface 226, such as about 10% to about 100%, about 20% to about 80%, about 40% to about 60%, or about 50% of the length of the lateral surface 226. The PDC 210 may contact the ionic transfer medium 230*c* along the upper surface 222 and the lateral surface 226. In an embodiment, positioning the PDC in contact with the ionic transfer medium 230*c* may include contacting the upper surface 222 of the superabrasive body 220 and at least a portion of the lateral surface 226 with the ionic transfer medium 230*c* (e.g., positioning the superabrasive body in the recess 231*c*). The resulting leached PDC 210*c* may include a first region 228 extending inward from the upper surface 222 and at least a portion of the lateral surface 226 of the superabrasive body 220*c* to the depth d therein. The depth d of the first region 228 may extend substantially parallel to the surfaces that contact the ionic transfer medium 230*c*. The leached PDC 210*c* may include a second region 229 extending inward from the interfacial surface 224. In an embodiment, at least a portion of the second region 229 may extend to the lateral surface 226, such as between the first region 228 and the substrate 212. The first region 228 may include at least a portion of the chamfer 227 and portions of the superabrasive body 220*c* adjacent to the chamfer 227.

Figure 2D:
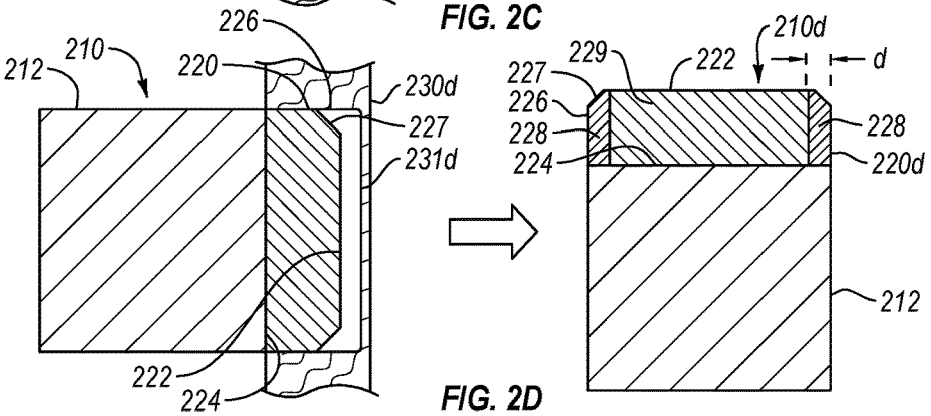

As shown in FIG. 2D, the ionic transfer medium 230*d* may contact only a portion of the lateral surface 226 of the superabrasive body 220. The ionic transfer medium 230*d* may include a recess 231*d* configured to accommodate at least a portion of the superabrasive body 220 therein. For example, the recess 231*d* may be configured to allow at least a portion of the lateral surface 226 to contact the ionic transfer medium 230*d*. The recess 231*d* may extend the entire diameter of the upper surface 222 and more than the entire length of the lateral surface 226. The recess 231*d* may be deeper than the lateral surface 226, such that the entire lateral surface may contact the ionic transfer medium 230*d* while the upper surface 222 remains spaced therefrom, such as by air or an insulating material in the bottom of the recess 231*d*. The PDC 210 may contact the ionic transfer medium 230*d* along only a portion of the lateral surface 226 or the entire lateral surface 226. In an embodiment, positioning the PDC in contact with the ionic transfer medium 230*d* may include contacting only a portion of the lateral surface 226 of the superabrasive body 220 with the ionic transfer medium 230*d*. The resulting leached PDC 210*d* may include a first region 228 extending inward from the lateral surface 226 of the superabrasive body 220*d* to the depth d therein. The depth d of the first region 228 may extend substantially parallel to the surface contacting the ionic transfer medium 230 (e.g., the lateral surface 226). The leached PDC 210*d* may include a second region 229 extending inward from the interfacial surface 224. In an embodiment, at least a portion of the second region 229 may extend to the upper surface 222, such as portion interior to the first region 228. The first region 228 may exhibit a substantially annular configuration about at least a portion of the second region 229. In an embodiment, the first region 228 may include at least a portion of the chamber 227 and/or portions of the superabrasive body 220*d* adjacent to the chamfer 227.

Figure 2E:
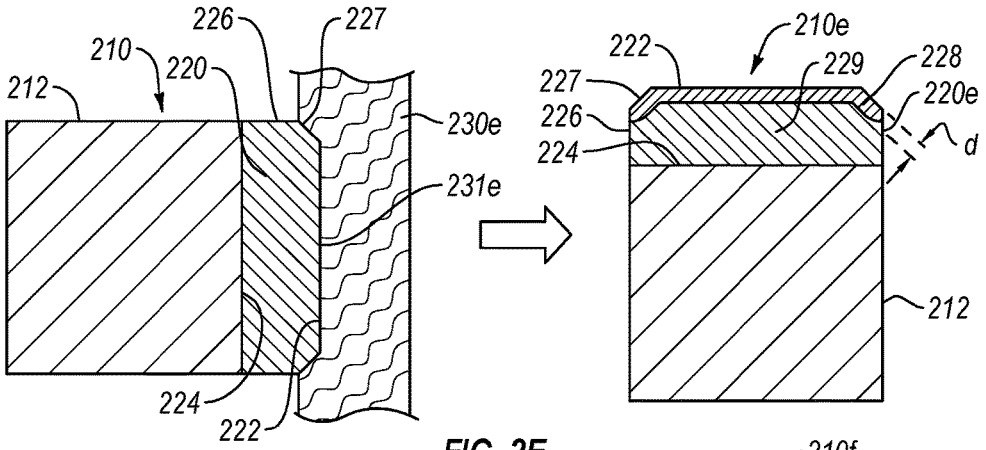

As shown in FIG. 2E, the ionic transfer medium 230*e* may contact the upper surface 222 and at least a portion of the chamfer 227 of the superabrasive body 220. The ionic transfer medium 230*e* may include a recess 231*e* configured to accommodate at least a portion of the superabrasive body 220 therein. For example, the recess 231*e* may be configured to allow at least a portion of both of the upper surface 222 and the chamfer 227 to contact the ionic transfer medium 230*e*. In an embodiment, the recess 231*e* may extend the entire diameter of the upper surface 222 and at least a portion of the length (e.g., both depth and lateral length) of the chamfer 227. In an embodiment, the recess 231*e* may be configured to extend at least about 10% of the length of the chamfer 227, such as about 10% to about 100%, about 20% to about 80%, about 40% to about 60%, or about 50% of the length of the chamfer 227. The PDC 210 may contact the ionic transfer medium 230*e* along the upper surface 222 and the chamfer 227. In an embodiment, positioning the PDC in contact with the ionic transfer medium 230*e* may include contacting the upper surface 222 of the superabrasive body 220 and at least a portion of the chamfer 227 with the ionic transfer medium 230*e* (e.g., positioning the superabrasive body in the recess 231*e*). The resulting leached PDC 210*e* may include a first region 228 extending inward from the upper surface 222 and at least a portion of the chamfer 227 of the superabrasive body 220*e* to the depth d therein. The depth d of the first region 228 may extend substantially parallel to the surfaces that contact the ionic transfer medium 230*e*. The leached PDC 210*c* may include a second region 229 extending inwardly from the interfacial surface 224. In an embodiment, at least a portion of the second region 229 may extend to the lateral surface 226, such as between the first region 228 and the substrate 212.

Figure 2F:
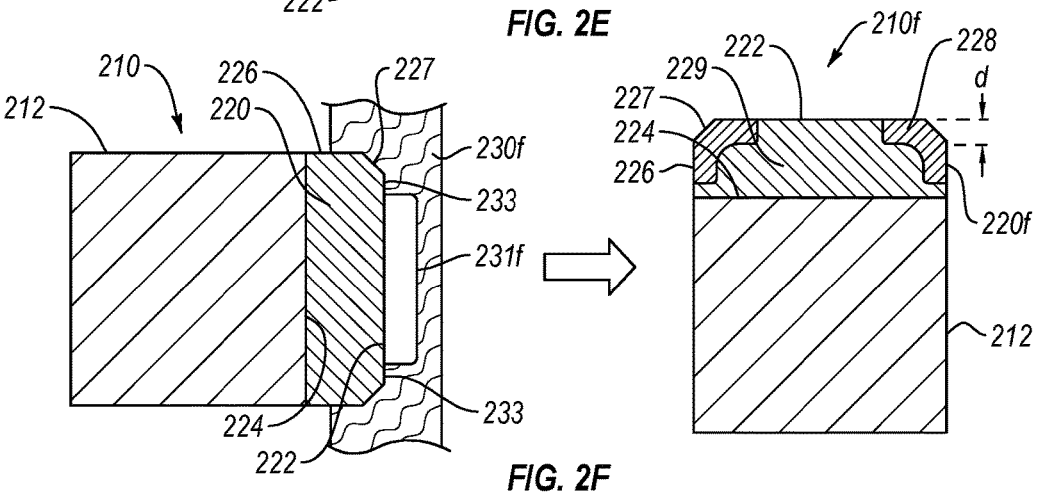

As shown in FIG. 2F, the ionic transfer medium 230*f* may include a surface configured to contact at least a portion of one or more of the upper surface 222, the lateral surface 226, or the chamfer 227 of the superabrasive body 220. The ionic transfer medium 230*f* may include a recess 231*f* configured to accommodate at least a portion of the superabrasive body 220 therein. The recess 231*f* may be configured to allow at least a portion of one or more of the upper surface 222, the lateral surface 226, or the chamfer 227 to contact the ionic transfer medium 230*f*. For example, the recess 231*f* may extend along substantially the entirety of the upper surface 222, at least a portion of the length of the lateral surface 226, and at least a portion of the length of the chamfer 227. The recess 231*f* may provide a contact surface for at least a portion of the upper surface 222, at least a portion of the lateral surface 226, and/or at least a portion of the chamfer 227. For example, the ionic transfer medium 230*d* may cover or contact any of the distances or percentages of those surfaces described above for the upper, lateral and/or chamfer surfaces. The recess 231*f* may include a portion being deeper than the rest of the recess, such that lands 233 formed therein may only contact an outer or peripheral portion of the upper surface 222. In an embodiment, PDC 210 may contact the ionic transfer medium 230*f* along one or more of the upper surface 222, the lateral surface 226, and the chamfer 227. In an embodiment, positioning the PDC in contact with the ionic transfer medium 230*f* may include contacting at least a portion of the upper surface 222, at least a portion of the lateral surface 226, and/or at least a portion of the chamfer 227 with the ionic transfer medium 230*f* (e.g., positioning the superabrasive body at least partially into the recess 231*f*). In an embodiment, positioning the PDC in contact with the ionic transfer medium 230*f* may include contacting at least a portion of the upper surface 222 with the lands 233. The resulting leached PDC 210*f* may include a first region 228 extending inward from peripheral portions of the upper surface 222, at least a portion of the lateral surface 226, and at least a portion of the chamfer 227 of the superabrasive body 220*f* to respective depths d therein. The depth(s) d of the first region 228 may extend substantially parallel to the surfaces that contact the ionic transfer medium 230*f*. The leached PDC 210*f* may include a second region 229 extending inwardly from the interfacial surface 224. In an embodiment, at least a portion of the second region 229 may extend to the lateral surface 226, such as between the first region 228 and the substrate 212.

Figure 2G:
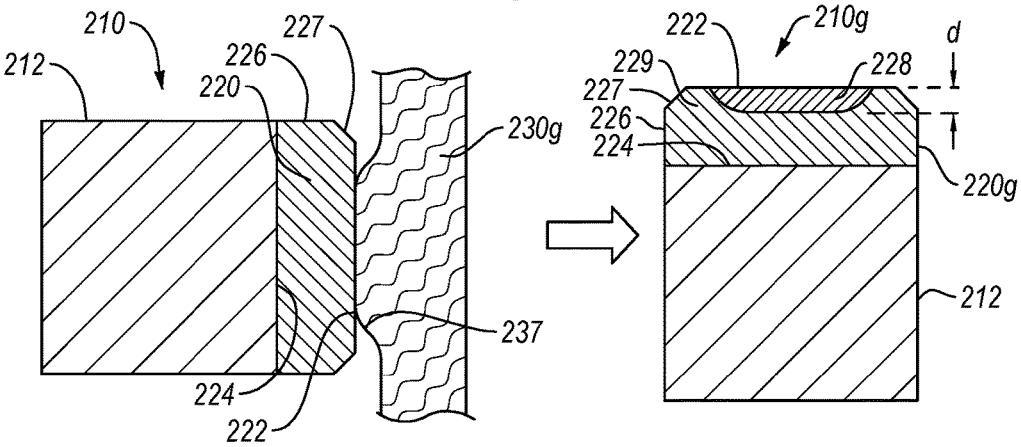

As shown in FIG. 2G, the ionic transfer medium 230*g* may include a substantially planar surface having one or more protrusions 237 to contact the PDC. The PDC 210 may contact the ionic transfer medium 230*g* along only a portion of the upper surface 222. The ionic transfer medium 230*g* may include at least one protrusion 237 configured to contact less than the entire upper surface 222 of the superabrasive body 220. For example, the at least one protrusion 237 may include a substantially planar surface set off (e.g., raised) from adjacent portions of the ionic transfer medium 230*d*. The at least one protrusion may be configured to contact less than 100% of the upper surface 222, such as about 10% to about 90%, about 25% to about 75%, about 40% to about 60%, about 50%, or about 20%. In an embodiment, the at least one protrusion 237 may be configured to contact a central portion of the upper surface 222. In an embodiment, the at least one protrusion 237 may be configured to contact a peripheral portion of the upper surface 222. The at least one protrusion 237 may include a plurality of protrusions configured to contact one or more discrete portions of the upper surface 222. In an embodiment, positioning the PDC in contact with the ionic transfer medium 230*g* may include contacting a portion of the upper surface 222 of the superabrasive body 220 with the at least one protrusion 237 of the ionic transfer medium 230*g*. The resulting leached PDC 210*g* may include a first region 228 extending inward from the central portion of the upper surface 222 of the superabrasive body 220*g* to depth d therein. The depth d of the first region 228 may extend substantially parallel to the surface contacting the ionic transfer medium 230*g* (e.g., the upper surface 222). The depth d may extend substantially uniformly across substantially the entirety of the upper surface 222. The first region 228 may include a reduced amount (e.g., as compared to the as-sintered, non-leached PCD) of interstitial constituent therein. The leached PDC 210*g* may include a second region 229 extending inward from the interfacial surface 224. The second region 229 may include substantially more of the interstitial constituent therein than the first region 228, such as substantially the same amount of interstitial constituent that was present before leaching. In an embodiment, the second region 229 may extend along substantially the entire lateral surface 226. At least a portion of the second region 229 may extend about the first region 228. The second region 229 may include at least a portion of the chamfer 227 or at least a portion of the superabrasive body 220*g* adjacent to the chamfer 227.

In an embodiment, combinations of any of the configurations disclosed with respect to FIGS. 2A-2G may be used by combining any of the materials or acts respectively described therewith. Any of a myriad of configurations for the ionic transfer assembly may be used to remove the interstitial constituents from a PDC (e.g., PCD of a PDC). Various embodiments are depicted in FIGS. 3-7.

Figure 3:
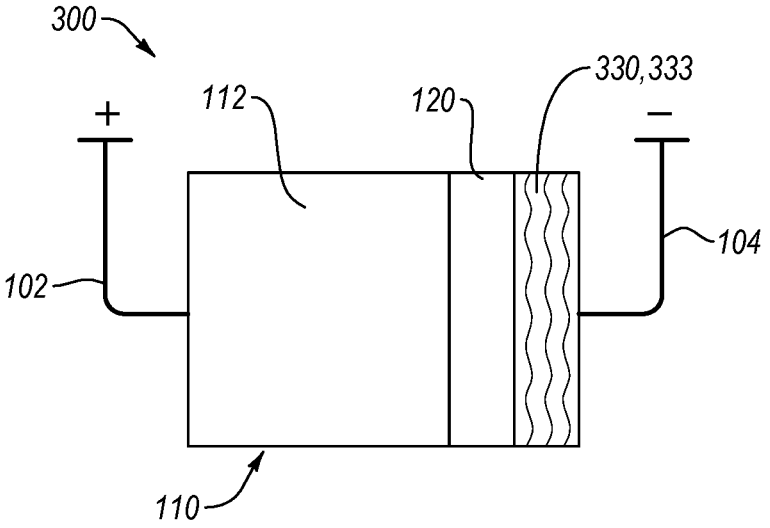
FIGS. 3-7 are schematic diagrams of ionic transfer assemblies, according to various embodiments.

FIG. 3 is a schematic diagram of an embodiment of an ionic transfer assembly 300 having a PDC 110 therein. The ionic transfer assembly 300 may include a first electrical connection 102 and a second electrical connection 104. The first electrical connection 102 may be operably coupled (e.g., in electrical communication) to the PDC 110. The PDC 110 may include a substrate 112 bonded to a superabrasive body 120. In an embodiment, the PDC 110 may include only the superabrasive body 120. In an embodiment, the first electrical connection 102 may be electrically connected to the substrate 112. At least a portion of the PDC 110, such as at least a portion of the superabrasive body 120, may be in contact with an ionic transfer medium 330 such that the superabrasive body 120 is in chemical and/or electrical communication therewith. In an embodiment, the ionic transfer medium 330 may include a gel 333. In an embodiment, removing interstitial constituents from a superabrasive body 120 may include using the gel 333 as the ionic transfer medium 330. The gel 333 may include one or more of an agarose gel, polyethylene glycol ("PEG") gel, ion exchange resin, or any other gel capable of selectively allowing ions (e.g., oxidized interstitial constituent) therethrough. The first electrical connection 102 or the second electrical connection 104 may include an electrically conducting material (e.g., a metal or metal alloy) configured to deliver an electrical charge, such as a plate, strip, bar, clip, wire, or coil. In an embodiment, the gel 333 may be operably coupled directly to the second electrical connection 104. In an embodiment, a portion of the gel 333 may at least partially act as an ionic reservoir. For example, the gel 333 may include an ion source (e.g., cation exchange resin and/or electrolyte solution) therein. In such an embodiment, the gel 333 may include a portion that bridges or separates the superabrasive body from the portion of the gel 333 that acts as the ionic reservoir, such as a gradient (e.g., electrochemical, ionic, or porous gradient). As an electrical bias is applied at the first and second electrical connections 102 and 104, the interstitial constituent present in the superabrasive body 120 may oxidize to an ionic form. Further, such an oxidized constituent may migrate through the superabrasive body and the gel 333 toward the source of negative potential (e.g., second electrical connection 104 in the portion of the gel 333 distal to the superabrasive body 120). In an embodiment, the gel 333 may be operably coupled (e.g., in chemical and/or electrical communication) to an ionic reservoir having the second electrical connection operably coupled thereto.

Figure 4:
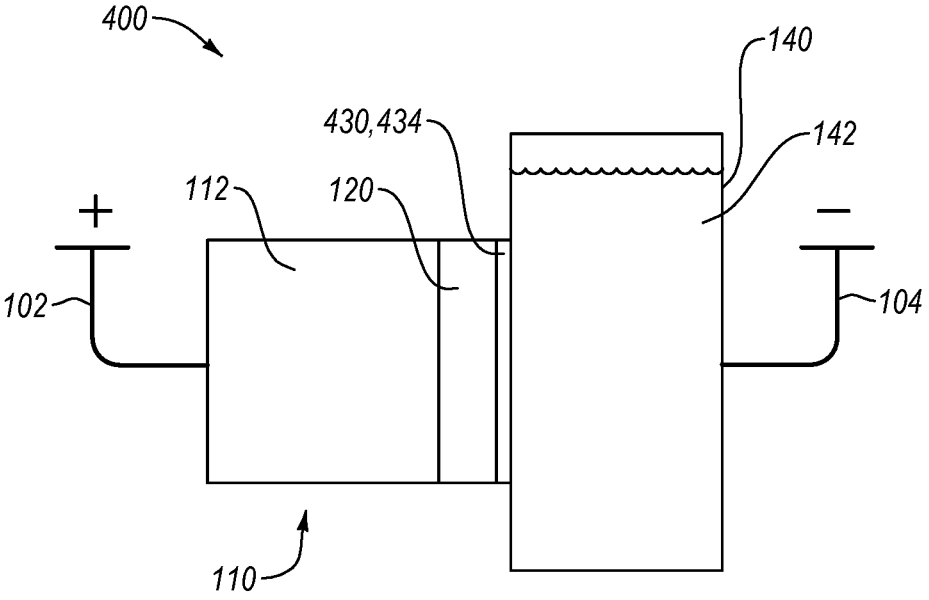

FIG. 4 is a schematic diagram of an embodiment of an ionic transfer assembly 400 having a PDC 110 therein. The ionic transfer assembly 400 may include a first electrical connection 102 and a second electrical connection 104. The first electrical connection 102 may be operably coupled (e.g., in electrical communication) to the PDC 110. The PDC 110 may include a substrate 112 bonded to a superabrasive body 120. In an embodiment, the PDC 110 may include only the superabrasive body 120. In an embodiment, the first electrical connection 102 may be electrically connected to the substrate 112. At least a portion of the PDC 110, such as at least a portion of the superabrasive body 120, may be in contact with an ionic transfer medium 430 such that the superabrasive body 120 is in chemical and/or electrical communication therewith. The ionic transfer medium 430 may include a membrane 434. The membrane 434 may include one or more of an ion selective membrane, a partially porous membrane, or a size selective membrane. For example, the membrane 434 may exhibit an average pore size sufficient to allow only interstitial constituents below the average pore size therethrough. In some embodiments, the membrane 434 may include one or more of polyacrylamide, one or more PEGs, polyacrylic acid, hydroxyapatite, or other suitable materials. In an embodiment, the membrane 434 may be configured as an ion selective membrane (e.g., cation selective membrane). In an embodiment, substantially only ionic materials (e.g., cationic or anionic) may be transferred therethrough. In some embodiments, suitable cation selective membranes may include polyvynil chloride ("PVC") based membranes, graphitic membranes, membranes having chelating resins (e.g., DOWEX™ M4195), any of the foregoing suspended in a matrix, any other material capable of facilitating transport of one or more ionic interstitial constituents from the superabrasive body, or combinations of any of the above. In an embodiment, the membrane 434 may include an ion exchange resin (e.g., cation exchange resin) configured to transport or bind at least one oxidized interstitial constituent therein.

In an embodiment, the membrane 434 may be operably coupled (e.g., in chemical/ionic and/or electrical communication) to an ionic reservoir 140 having the second electrical connection 104 operably coupled thereto. Optionally, the membrane 434 may serve to separate (e.g., bridge) the ionic reservoir 140 from the superabrasive body 120. The ionic reservoir 140 may be configured as a tank, vessel, or other storage medium capable of holding a fluid therein. The second electrical connection 104 may be located (e.g., secured to) in a portion (e.g., side) of the ionic reservoir 140 (e.g., distant from the membrane 434). The second electrical connection 104 may include a portion of conducting material disposed at least partially within the ionic reservoir 140. For example, the second electrical connection 104 may include a conductive plate or coil disposed in and configured to provide a relatively large area of negative potential to the ionic reservoir 140. The ionic reservoir 140 may include a container constructed of a material configured to remain generally chemically and electrically inert during use of the ionic transfer assembly 400. Suitable materials may include plastic, acrylic, PVC, polyetheretherketone ("PEEK"), insulated stainless steel, insulated aluminum, or any other material capable of remaining generally stable under acidic conditions, basic conditions, and/or when an electrical voltage and/or current is applied thereto.

The ionic reservoir 140 may include an electrolyte solution 142 therein. The electrolyte solution 142 may include any solution configured to provide one or more ions or an ionic gradient therein. In an embodiment, the electrolyte solution 142 may include an ion source having one or more of an inorganic acid (e.g., aqua regia, hydrobromic acid, hydrochloric acid, hydrofluoric acid, hydroiodic acid, nitric acid, mixtures thereof, etc.); an organic acid (e.g., ascorbic acid, benzoic acid, butyric acid, carbonic acid, citric acid, formic acid, lactic acid, malic acid, oxalic acid, propionic acid, pyruvic acid, succinic acid, etc.); or ions, salts, or esters of any of the foregoing. For example, the electrolyte solution 142 may include a citric acid/citrate solution. The electrolyte solution 142 may include any of those electrolytes, in any concentration and/or pH, disclosed in U.S. Provisional Patent Application No. 62/096,315 the disclosure of which is incorporated herein above. The electrolyte solution 142 in the ionic reservoir 140 may be heated or cooled depending on the composition thereof or the desired processing time for the PDC 110. The temperature of the electrolyte solution 142 may be greater than about 0° C., such as about 20° C. to about 100° C.

The ion source may be present in the electrolyte solution in a molarity of 0.01 M or greater, such as about 0.01 M to about 10 M, about 0.1 M to about 5, about 1M to about 3 M, about 0.15 M to about 1 M, about 0.2 M, about 0.3M, about 0.5M, about 1 M, or about 2 M. The pH of the electrolyte solution 142 may be acidic such as 6.9 pH or lower. In an embodiment, the pH of the electrolyte solution 142 may be only slightly acidic, such as between 6.9 pH and about 5 pH or about 6.5 pH and about 6 pH. In an embodiment, the electrolyte solution may be strongly acidic, such as an aqua regia solution having a pH of about 2 or less. In an embodiment, the pH of the electrolyte solution 142 may be basic such as 7.1 pH or higher. In an embodiment, the electrolyte solution may include an at least 0.2 M (e.g., about 0.3 M) citric acid/citrate solution. The citric acid may serve to provide a slightly acidic electrochemical gradient suitable for transporting oxidized interstitial constituent toward the negative potential and/or to chelate the oxidized interstitial constituent (e.g., iron, cobalt, or nickel).

In some embodiments, as an electrical bias is applied at the first and second electrical connections 102 and 104, the interstitial constituent present in the superabrasive body 120 may electrically oxidize to an ionic form and migrate through the superabrasive body 120 and the membrane 434 toward the source of negative potential (e.g., ionic reservoir 140 or the second electrical connection 104 associated therewith).

Figure 5:
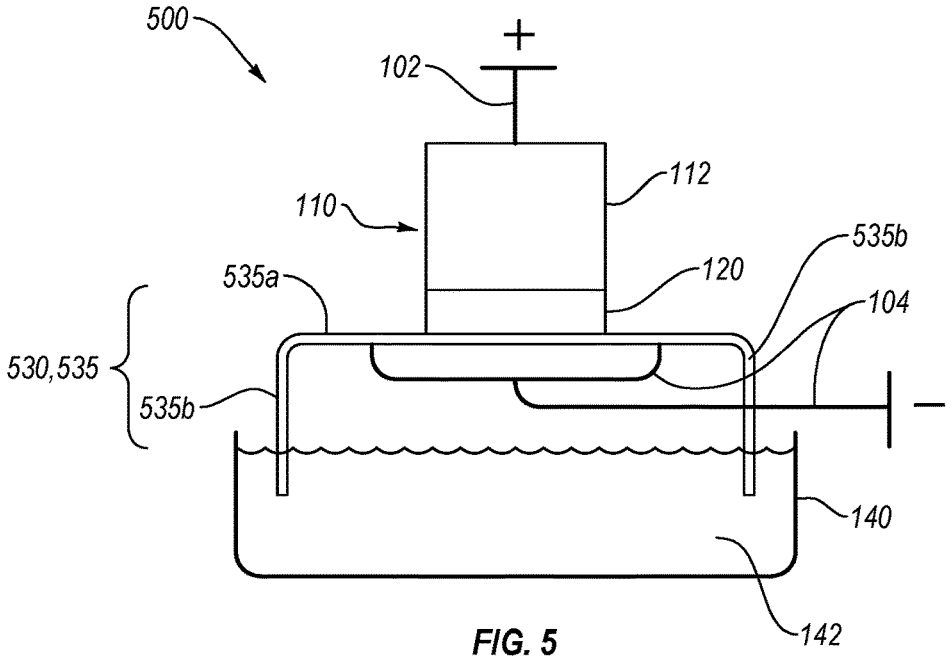

FIG. 5 is a schematic diagram of an embodiment of an ionic transfer assembly 500. The ionic transfer assembly 500 may include a first electrical connection 102 and a second electrical connection 104. The first electrical connection 102 may be coupled to the PDC 110. The PDC 110 may include the substrate 112 and the superabrasive body 120. The ionic transfer assembly 500 may include an ionic transfer medium 530 positioned and configured to contact a portion of the PDC 110. For example, the ionic transfer medium 530 may include a filter paper 535, spongy materials, or porous sponge-like matrix material. Suitable filter paper 535 material may include pulp (e.g., natural cellulose), glass fibers, mineral fibers, plant fibers, polymers, nitrocellulose, or combinations of any of the foregoing.

The filter paper 535 may be in contact with one or more of a chemical, fluid, and/or electrical connection with the ionic reservoir 140. The filter paper 535 may be configured with a porosity sufficient to wick, transfer, and/or retain an electrolyte solution 142 from or to the ionic reservoir 140. The filter paper 535 may be configured such that only a portion thereof is in contact with the electrolyte solution 142. For example, the filter paper 535 may include an interfacing section 535*a* and one or more wicking sections 535*b*. The interfacing section 535*a* may be positioned and configured to contact at least a portion of one or more PDCs 110 (e.g., the superabrasive body 120), but not contact the ionic reservoir 140 directly. The wicking sections 535*b* may extend from the interfacing section 535*a* at a non-parallel angle thereto. For example, the wicking sections 535*b* may extend from the interfacing section 535*a* and into the ionic reservoir 140. The wicking sections 535*b* may serve to chemically connect the interfacing section 535*a* with the electrolyte solution 142. In an embodiment, the ionic reservoir 140 may be positioned below superabrasive body 120 such with at least a portion of the filter paper 535. The electrolyte solution 142 in the ionic reservoir 140 may include any electrolyte solution disclosed herein.

The second electrical connection 104 may be positioned adjacent to the filter paper 535 (e.g., in contact with the interfacing section 535*a*). The second electrical connection 104 may be configured as a plate or other surface capable of supporting the filter paper 535 and one or more PDCs 110 thereon. In an embodiment, the second electrical connection 104 may be disposed in the electrolyte solution 142 rather than adjacent (e.g., directly connected) to the filter paper 535. Upon application of an electrical bias or voltage to the first and second electrical connections 102 and 104, the interstitial constituent from the superabrasive body 120 may travel through the interfacing section 535*a* toward the source of negative potential at the second electrical connection 104. The build-up of oxidized interstitial constituent in the interfacing section 535*a* may cause the filter paper to transport the oxidized interstitial constituent to the ionic reservoir 140 via electrochemical gradient. The oxidized interstitial constituent may travel to the ionic reservoir 140 via the one or more wicking sections 535*b*, whereupon the interfacing section 535*a* may draw more oxidized interstitial constituent from the superabrasive body 120. In an embodiment, the ionic transfer assembly 500 may operate without applying an electrical bias or voltage. In a working example, the ionic transfer assembly 500 was able to remove cobalt catalyst from a PCD table to depth of about 100 μm in about 7 days without applying an electrical bias thereto. In an embodiment, the ionic transfer assembly 500 may have a vertical arrangement wherein the ionic reservoir 140 is positioned below the interfacing section 535*a* of the filter paper 535. The second electrical connection 104 may be positioned below the interfacing section 535*a* of the filter paper 535 and in electrical communication therewith. One or more PDCs 110 may be disposed on the filter paper 535 with the superabrasive body 120 facing downward, such that at least a portion of the upper surface of the superabrasive body 120 may contact (e.g., physically, electrically, or chemically interface with) the filter paper 535. The first electrical connection 102 may be coupled to the substrate 112 such that a voltage (e.g., a positive potential) may be applied thereto.

In another embodiment, rather than the filter paper 535 being disposed in the electrolyte solution, a solid hydrated support (e.g., block of any ionic transfer material disclosed herein) may be disposed in the electrolyte solution 142 and have the second electrode operably connected thereto. The PDC 110 may be in contact with the solid hydrated support (e.g., positioned and configured above the surface of the electrolyte solution 142) to allow removal of the interstitial constituent through the solid hydrated support. The solid hydrated support may be configured to contact and/or support one or more portions of the PDC 110 (e.g., hold the PDC 110 above the surface of the electrolyte solution 142).

Figure 6:
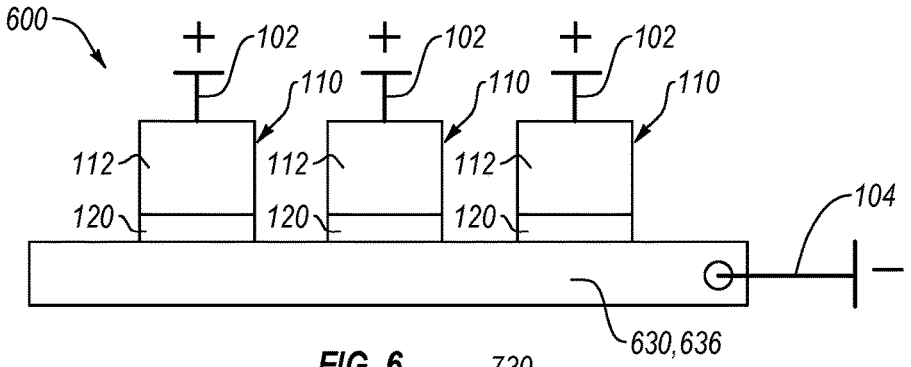

FIG. 6 is a schematic diagram of an embodiment of an ionic transfer assembly 600. The ionic transfer assembly 600 may include one or more first electrical connections 102 and one or more second electrical connections 104. The one or more first electrical connections 102 may each be coupled to at least one PDC 110. Each PDC 110 may include the substrate 112 and the superabrasive body 120. The ionic transfer assembly 600 may include an ionic transfer medium 630 positioned and configured to contact a portion of one or more PDCs 110. For example, the ionic transfer medium 630 may include a solid polymer electrolyte ("SPE") 636 having a porous construction. In an embodiment, the solid polymer electrode ("SPE") 636 may include a dry polymer electrolyte (e.g., including a ceramic material and a polymer such as one or more of polytetrafluoroethylene ("PTFA"), a PEG, a polyethylene oxide ("PEO"), a poly(methyl methacrylate) ("PMMA"), a polyacrylonitrile ("PAN"), siloxanes, etc.), an organic ionic plastic, a gel electrolyte, or combinations of any of the foregoing. In an embodiment, the SPE 636 may also be in ionic communication with or act as the ionic reservoir. The SPE 636 may be in electrical communication with at least one second electrical connection 104. In an embodiment, the SPE 636 may be in electrical and/or chemical communication with the second electrical connection 104. The SPE 636 may optionally act as both the ionic transfer medium 630 and the ionic reservoir. For example, a plurality of first and second electrical connections 102 and 104 may be electrically biased such that at least a portion of the interstitial constituent of one or more superabrasive bodies 120 in contact therewith is oxidized and transferred into the SPE 636 via electrochemical gradient therein. The SPE 636 may be configured with selected porosity or chemical composition to transfer at least enough interstitial constituent therethrough or therein to leach the superabrasive body 120 to a desired depth. In an embodiment (not shown), the SPE 636 may be in contact (e.g., ionic communication) with an ionic reservoir (not shown). For example, the SPE 636 may be disposed between an ionic reservoir (not shown) and the PDC 110. In an embodiment, the SPE 636 may be positioned substantially horizontally and one or more PDCs 110 may be positioned thereon with the superabrasive body 120 facing the SPE 636 (e.g., facing downward on top of the SPE 636). In an embodiment, the SPE 636 may be arranged substantially vertically with one or more PDCs 110 in ionic communication with a side surface thereof. During operation, a positive potential may be applied at the first electrical connection 102 and a negative potential may be applied at the second electrical connection 104, which may oxidize the interstitial constituent in the superabrasive body 120 and facilitate or induce the (oxidized) interstitial constituent to move toward the negative potential at the second electrical connection 104, thereby removing the interstitial constituent from at least a portion of the superabrasive body 120.

Figure 7:
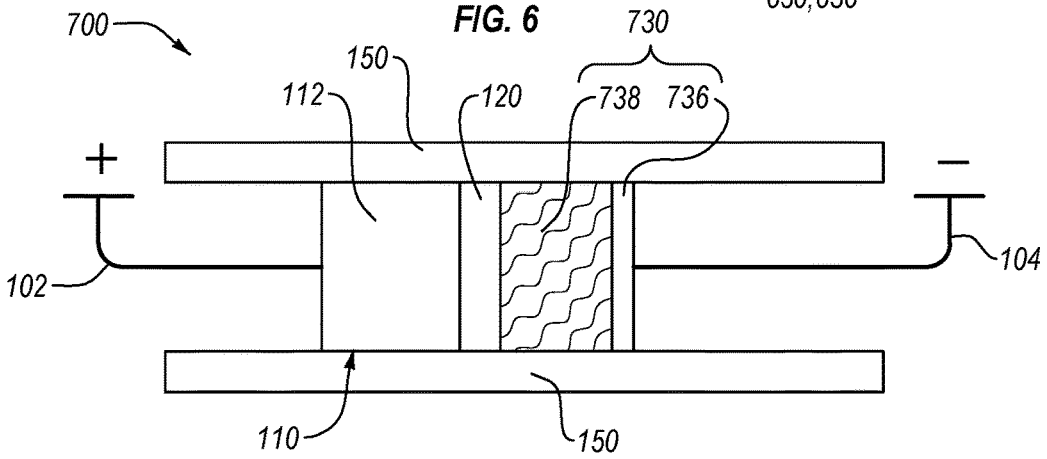

FIG. 7 is a schematic diagram of an embodiment of an ionic transfer assembly 700. The ionic transfer medium 730 of the ionic transfer assembly 700 may include a SPE and a supercritical fluid disposed against the PDC. The ionic transfer assembly 700 may include one or more first electrical connections 102 and one or more second electrical connections 104. The one or more first electrical connections 102 may each be coupled to at least one PDC 110. Each PDC 110 may include the substrate 112 and the superabrasive body 120. Optionally, the ionic transfer assembly 700 may include a housing 150 configured to hold the PDC 110 under a fluid tight seal therein. For example, the housing 150 may include a metallic tube, pipe, or conduit configured to at least partially provide a seal around the lateral surface of the PDC, such that fluid (e.g., a gas or a liquid) or supercritical fluid may not escape between the housing 150 and the PDC 110. In an embodiment, the housing 150 may include a sealing member (not shown) such an O-ring, flange, gasket, etc. configured to provide a seal around at least a portion of the PDC 110 in the housing 150. The ionic transfer assembly 700 may include an ionic transfer medium 730 positioned and configured to contact at least a portion of one or more PDCs 110, such as the superabrasive body 120. The ionic transfer medium may include a SPE 736 and a supercritical fluid 738. The SPE 736 may be similar or identical to the SPE 636 described herein. The SPE 736 may be shaped and positioned within the housing 150 to provide a substantially seal against the housing 150. The SPE 736 may be spaced from the superabrasive body 120 a distance. The housing may include one or more seals, flanges, gaskets, etc. (not shown) configured to hold the SPE 736 in place and provide a seal between the SPE 736 and the housing 150. The one or more second electrical connections 104 may be operably coupled to the SPE 736, whereby a potential (e.g., a negative potential) may be introduced to ionic transfer assembly 700 at the one or more second electrical connections 104 upon activation.

The supercritical fluid 738 may be disposed between the SPE 736 and the superabrasive body 120 in the housing 150. While the ionic transfer assembly 700 is inactive, the supercritical fluid 738 may be in a non-supercritical state, such as in a liquid or gaseous state until supercritical conditions are induced. The supercritical fluid 738 may include a fluid, such as any electrolyte solution disclosed herein, in any concentration or pH disclosed herein. The supercritical fluid 738 or method of making or using the same may include any of the supercritical fluids, individual components thereof (e.g., supercritical fluid component, aqueous component, leaching agent, or chelating agent), or methods of making or using the same disclosed in U.S. patent application Ser. No. 14/520,188, the disclosure of which is incorporated herein, by this reference, in its entirety. For example, the supercritical fluid 738 may include one or more of carbon dioxide, water, methane, ethane, propane, ethylene, propylene, methanol, ethanol, acetone, pentane, butane, hexamine, heptane, sulfur hexafluoride, xenon dichlorodifluoromethane, trifluoromethane, isopropanol, nitrous oxide, ammonia, methylamine, diethyl ether, hydrofluoric acid, nitric acid, hydrochloric acid, aqua regia, one or more chelating agents, or combinations of any of the foregoing in any concentration, ratio, pressure, temperature, or pH disclosed. Upon elevation of temperature and/or pressure of the ionic transfer assembly 700, the supercritical fluid 738 may be brought to a supercritical state whereby ionic transport (between the superabrasive body 120 and the negative potential at the SPE 736) may be effectuated therethrough. The first and second electrical connections 102 and 104 may be activated (e.g., electrically biased) to provide a positive and negative potential, respectively. Upon activation of the first and second electrical connections 102 and 104, and inducing a supercritical fluid state in the supercritical fluid 738; oxidation of at least some of the interstitial constituents in the superabrasive body 120 may occur. Further, ionic transport of the oxidized interstitial constituents through the supercritical fluid 738 (e.g., via electrochemical gradient therein) may transport the oxidized interstitial constituent out of the superabrasive body 120.

In an embodiment, creating or providing the supercritical state may include changing (e.g., raising) one or more of the temperature or pressure of the ionic transfer assembly 700 or portions thereof (e.g., supercritical fluid 738 containing portion of the housing 150) from an ambient state. Supercritical conditions may be created by application of elevated heat and/or pressure to or within the housing 150. The elevated heat and/or pressure necessary to bring the supercritical fluid 738 to a supercritical state may be dependent upon the components of the supercritical fluid 738. In an embodiment, changing the temperature of the ionic transfer assembly includes changing the temperature of substantially only the supercritical fluid 738 containing portion of the housing 150. For example, the housing 150 may include one or more substantially adiabatic portions adjacent to the substrate 112 and the SPE 736, such that heating may be localized in the supercritical fluid, such as by an induction coil adjacent thereto. The housing 150 may include a cap or seal (not shown) at one or more ends thereof, which may additionally seal the contents of the housing 150 therein.

Figure 8:
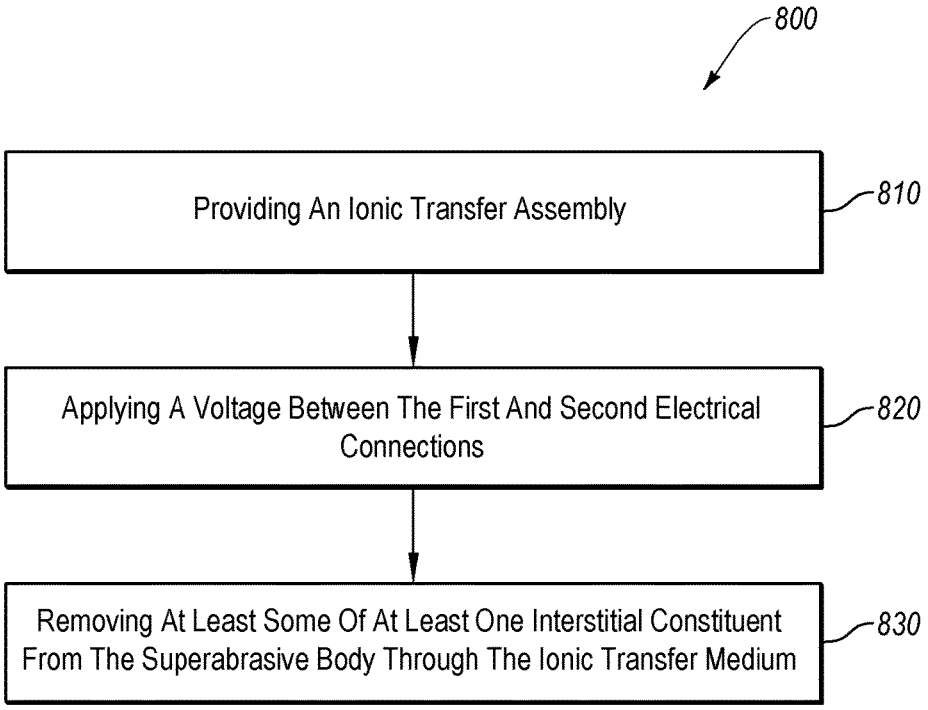
FIG. 8 is a flow diagram of a method of removing interstitial constituents from a PDC including a superabrasive body, according to an embodiment.

FIG. 8 is a flow diagram of a method 800 of removing interstitial constituents from a PDC including a superabrasive body. As explained in more detail below, the method 800 may include an act 810 of providing an ionic transfer assembly, an act 820 of applying a voltage between the first and second electrical connections and an act 830 of removing at least some of the oxidized at least one interstitial constituent from the PDC through the ionic transfer medium.

The method 800 may include the act 810 of providing an ionic transfer assembly. The ionic transfer assembly or any component thereof may be configured similar or identical to any ionic transfer assembly or component thereof disclosed herein. For example, the ionic transfer medium may be configured similar or identical to any ionic transfer medium disclosed herein. In an embodiment, the ionic transfer assembly may include a first electrical connection operably coupled to a PDC having a superabrasive body including a plurality of bonded superabrasive grains and at least one interstitial constituent therebetween. The ionic transfer assembly may include an ionic transfer medium configured to be in electrical and/or chemical communication with the PDC along at least one surface therebetween. The ionic transfer assembly may further optionally include an ionic reservoir in electrical and chemical communication with the ionic transfer medium and separated from the PDC by the ionic transfer medium, the ionic reservoir including a second electrical connection operably coupled thereto and configured to apply a voltage to the ionic reservoir. In an embodiment, the ionic reservoir may be configured as a portion of the ionic transfer medium, such as a portion remote from the surface thereof in contact with the PDC 110.

The method 800 may include the act 820 of applying a voltage between the first and second electrical connections. For example, doing so may cause at least some of the at least one interstitial constituent to oxidize. The act 820 may include inducing a positive potential at the first electrical connection and a negative potential at the second electrical connection. The voltage between the first and second electrodes may include any voltage disclosed herein or any other suitable voltage. In an embodiment, applying a voltage between the first and second electrical connections may be carried out for a specific duration, such as any duration disclosed herein or any other suitable duration. The act of applying voltage may include applying any voltage and/or current disclosed herein, for any duration disclosed herein. Applying voltage may include electrically oxidizing one or more interstitial constituents present in a polycrystalline diamond table.

The method 800 may include the act 830 of removing at least some of at least one interstitial constituent from the PDC through the ionic transfer medium. In an embodiment, removing at least some of the at least one interstitial constituent from the PDC through the ionic transfer medium may include providing an ionic transfer medium configured (e.g., having pore size, ionic affinity, thickness, etc.) to transport a specific interstitial constituent therethrough. For example, removing at least some of the oxidized at least one interstitial constituent from the PDC through the ionic transfer medium may be performed substantially simultaneously with applying a voltage between the first and second electrical connections. In an embodiment, at least one interstitial constituent may be oxidized and may be removed from the PDC by removing at least some of the interstitial constituent(s) from at least a portion of the superabrasive body adjacent to one or more of the upper surface, the chamfer, and/or the lateral surface. In an embodiment, removing at least some of the at least one interstitial constituent from the PDC includes applying a negative electrical potential (e.g., charge) to an electrolyte solution (e.g., acidic solution) in the ionic reservoir. In an embodiment, the electrolyte solution may include an acidic solution of any concentration disclosed herein, For example, the electrolyte solution may include a slightly acidic citric acid/citrate solution. The method may include moving the oxidized one or more interstitial constituents through a selective ionic transfer medium (e.g., ionic bridge) in contact with the polycrystalline diamond table, such as via one or more of an electrical bias and/or ionic or chemical gradient. The method includes receiving the one or more oxidized interstitial constituents in an ionic reservoir in chemical communication with the selective ionic transfer medium.

In an embodiment, providing an ionic transfer assembly may include an act of positioning the PDC in the ionic transfer assembly. In an embodiment, providing an ionic transfer assembly may include an act of positioning the PDC in any of the ionic transfer mediums herein to form a contact surface similar or identical to any of those disclosed in FIGS. 2A-2G. The PDC may include a superabrasive material (e.g., PCD body or table) having one or more of an upper surface, an interfacial surface, and a lateral surface therebetween. Optionally, the PDC may include a chamfer extending between the upper surface and the lateral surface. In an embodiment, the first electrical connection may be disposed on a portion of the superabrasive body and the superabrasive body may contact the ionic transfer medium along a contact surface therebetween. In some embodiments, the PDC may include a substrate (e.g., cemented tungsten carbide) bonded to the superabrasive body. In an embodiment, the PDC may include a polycrystalline diamond compact having a polycrystalline diamond body bonded to a tungsten carbide substrate. In an embodiment, the first electrical connection may be disposed on a portion of the substrate and the polycrystalline diamond body may contact the ionic transfer medium along at least one surface such that the polycrystalline diamond body is in electrical and/or chemical communication therewith. In an embodiment, positioning the PDC in the ionic transfer assembly includes positioning at least a portion of one or more of the upper surface, the lateral surface, and/or the chamfer in contact with the ionic transfer medium effective to create the contact or communication (e.g., electrical and/or chemical communication) therebetween. In an embodiment, positioning the PDC in the ionic transfer assembly includes positioning only a portion of at least one of the upper surface, the lateral surface, and/or the chamfer in contact with the ionic transfer medium.

Thus, the embodiments of workpieces (e.g., superabrasive compacts such as PDCs and/or PCDs) disclosed herein or formed by the leaching processes disclosed herein may be used in any apparatus or structure in which at least one conventional PDC is typically used. In one embodiment, a rotor and a stator, assembled to form a thrust-bearing apparatus, may each include one or more PCD elements and/or PDCs leached according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing the superabrasive elements and/or superabrasive compacts disclosed herein may be incorporated. The embodiments of superabrasive bodies and/or superabrasive compacts disclosed herein may also form all or part of heat sinks, wire dies, bearing elements, cutting elements, cutting inserts (e.g., on a roller-cone-type drill bit), machining inserts, or any other article of manufacture as known in the art. Other examples of articles of manufacture that may use any of the superabrasive bodies and/or superabrasive compacts disclosed or leached by the methods herein are disclosed in U.S. Pat. Nos. 4,811,801; 4,268,276; 4,468,138; 4,738,322; 4,913,247; 5,016,718; 5,092,687; 5,120,327; 5,135,061; 5,154,245; 5,180,022; 5,460,233; 5,544,713; and 6,793,681, the disclosure of each of which is incorporated herein, in its entirety, by this reference.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A method of removing interstitial constituents from a superabrasive body, the method comprising:

providing an ionic transfer assembly including:

a first electrical connection operably coupled to a superabrasive body including a plurality of bonded superabrasive grains and at least one interstitial constituent;

an ionic transfer medium in contact with the superabrasive body, the ionic transfer medium comprising a solid material or a gel; and an ionic reservoir in ionic communication with the ionic transfer medium and separated from the superabrasive body by the ionic transfer medium, the ionic reservoir including a second electrical connection operably coupled thereto;

applying a voltage between the first and second electrical connections; and removing at least some of the at least one interstitial constituent from the superabrasive body through the ionic transfer medium to the ionic reservoir.

2. The method of claim 1, further comprising positioning the superabrasive body against the ionic transfer medium, wherein the superabrasive body includes one or more of an upper surface, an interfacial surface, a lateral surface extending between the upper surface and the interfacial surface, and a chamfer extending between the upper surface and the lateral surface.

3. The method of claim 2, wherein:

the superabrasive body includes a polycrystalline diamond table, and the polycrystalline diamond table is bonded to a substrate;

the first electrical connection is with the substrate; and the polycrystalline diamond table contacts the ionic transfer medium such that the polycrystalline diamond table is in electrical and chemical communication with the ionic transfer medium.

4. The method of claim 3, wherein positioning the superabrasive body against the ionic transfer medium includes positioning at least one of the upper surface, the lateral surface, or the chamfer in contact with the ionic transfer medium.

5. The method of claim 4, wherein positioning at least one of the upper surface, the lateral surface, or the chamfer in contact with the ionic transfer medium includes positioning only a portion of at least one of the upper surface, the lateral surface, or the chamfer in contact with the ionic transfer medium.

6. The method of claim 3, wherein removing at least some of the at least one interstitial constituent from the superabrasive body includes removing at least some of the interstitial constituents from a portion of the superabrasive body adjacent to at least one of the upper surface, the chamfer, or the lateral surface.

7. The method of claim 1, wherein the ionic transfer medium includes a gel.

8. The method of claim 1, wherein the ionic transfer medium includes at least one of a porous paper, a sponge, a porous filter, or a membrane.

9. The method of claim 8, wherein the membrane includes one or more of an ion selective membrane, a partially porous membrane, or a size selective membrane.

10. The method of claim 1, wherein the ionic transfer medium includes a solid polymer electrode or a cation exchange resin.

11. The method of claim 10, wherein the ionic transfer medium includes a supercritical fluid and a solid polymer electrode material.

12. The method of claim 1, wherein applying a voltage between the first and second electrical connections includes applying a positive potential at the first electrical connection and a negative potential at the second electrical connection.

13. The method of claim 1, wherein:

the ionic reservoir includes an acidic solution; and removing at least some of the at least one interstitial constituent from the superabrasive body includes applying a negative electrical potential to the acidic solution.

* * * * *